United States Patent [19]

Kinoshita

[11] 4,059,122

[45] Nov. 22, 1977

[54] COIN CLASSIFYING AND COUNTING MACHINE

[75] Inventor: Yoshio Kinoshita, Himeji, Japan

[73] Assignee: Glory Kogyo Kabushiki Kaisha, Japan

[21] Appl. No.: 439,837

[22] Filed: Feb. 5, 1974

[30] Foreign Application Priority Data

Feb. 10, 1973 Japan ..... 48-17690
Feb. 12, 1973 Japan ..... 48-17618

[51] Int. Cl.[2] ..... G07D 3/04
[52] U.S. Cl. ..... 133/3 D; 133/8 R
[58] Field of Search ..... 133/8 R, 8 A–8 D, 133/3 R, 3 A–3 H, 3, 8

[56] References Cited

U.S. PATENT DOCUMENTS 3,026,982 3/1962 Buchholtz et al. ..... 133/3 R X
3,173,431 3/1965 Chichester et al. ..... 133/3 R
3,242,932 3/1966 Becker ..... 133/3 R X
3,332,430 7/1967 Busch ..... 133/3 R

*Primary Examiner*—Robert B. Reeves
*Assistant Examiner*—Joseph J. Rolla
*Attorney, Agent, or Firm*—Wenderoth, Lind & Ponack

[57] ABSTRACT

A coin classifying and counting machine has a hopper for collecting mixed coins of several different kinds, a coin delivery device including a revolving disc for scooping up coins from the bottom of the hopper, a delivery passageway for aligning and delivering in orderly sequence the coins thus conveyed, sorting devices installed in the delivery passageway for sorting the coins therein by kind, sorting passageways for conveying by kind the coins thus sorted, coin counting devices, one of which is installed in each sorting passageway to count the coins passing therethrough, and a coin receiver section comprising several chambers, each accommodating coins of a respective kind.

3 Claims, 33 Drawing Figures

COIN CLASSIFYING AND COUNTING MACHINE

BACKGROUND

This invention relates generally to coin-handling apparatus and more particularly to a coin classifying and counting machine which classifies mixed coins of numerous kinds according to denomination and counts the coins of each kind.

Heretofore, there have been many coin classifying machines, but coin classifying machines which also count the classified coins are very few in number. Among these counting machines, there has been one depending on a subtraction method, wherein a section for sorting by coin denomination is provided for each kind at an intermediate point on a coin passageway, and the number of passing coins are counted upstream and downstream from the coin sorting section, the difference between the resulting counted number being taken as the number of coins of that denomination. Furthermore, the counters used in these machines have been limited to a specific counter (e.g., of photoelectric type) and for this reason have lacked versatility, and, moreover, their counting accuracy has been poor.

Furthermore, in a conventional classification machine in the case where coin jamming or clogging occurs at the revolving disc or some point on the coin passageway, the discharging of the jammed coins has been troublesome work.

SUMMARY

It is a general object of this invention to provide a new and advanced coin classifying and counting machine in which the above described problems encountered in the prior art have been solved.

A first specific object of the invention is to provide a coin classifying and counting machine capable of carrying out the functions of classifying, by kinds, a mixture of coins of a plurality of denominations, counting the coins of each kind thus classified, and collecting the coins thus classified and counted in a collecting section divided into parts for respective kinds of coins.

A second specific object of the invention is to provide a coin classifying and counting machine in which coins which have been classified are sent into passageways for respective coin kinds, where the coins are caused to flow in orderly columns, during which they are counted by counting devices.

A third objct of the invention is to provide a coin classifying and counting machine in which, in the event of jamming or clogging of coins between a coin-carrying, revolving disc and a coin delivery passageway or within coin sorting passageways, the jammed or clogging coins can be discharged in a simple and rapid manner.

According to this invention in one aspect thereof, briefly summarized, there is provided a coin classifying and counting machine comprising: mixed coin hopper means for collecting and reserving mixed coins of a plurality of kinds; coin delivery means, including a resolving disc, for conveying coins from said hopper means; a delivery passageway for aligning and delivering in orderly sequence the coins thus conveyed; sorting devices installed at intermediate parts of said delivery passageway and sorting the coins therein by kind; sorting passageways for conveying by kind of coin the coins thus sorted; coin counting devices installed in respective sorting passageways to count coins of respective denominations; and a coin receiver section for accommodating in groups by denomination the coins thus counted.

The nature, principles, and utility of the invention will be more clearly apparent from the following detailed description when read in conjunction with the accompanying drawings, in which like parts are designated by like reference numerals and characters.

DRAWINGS

Figure 1:
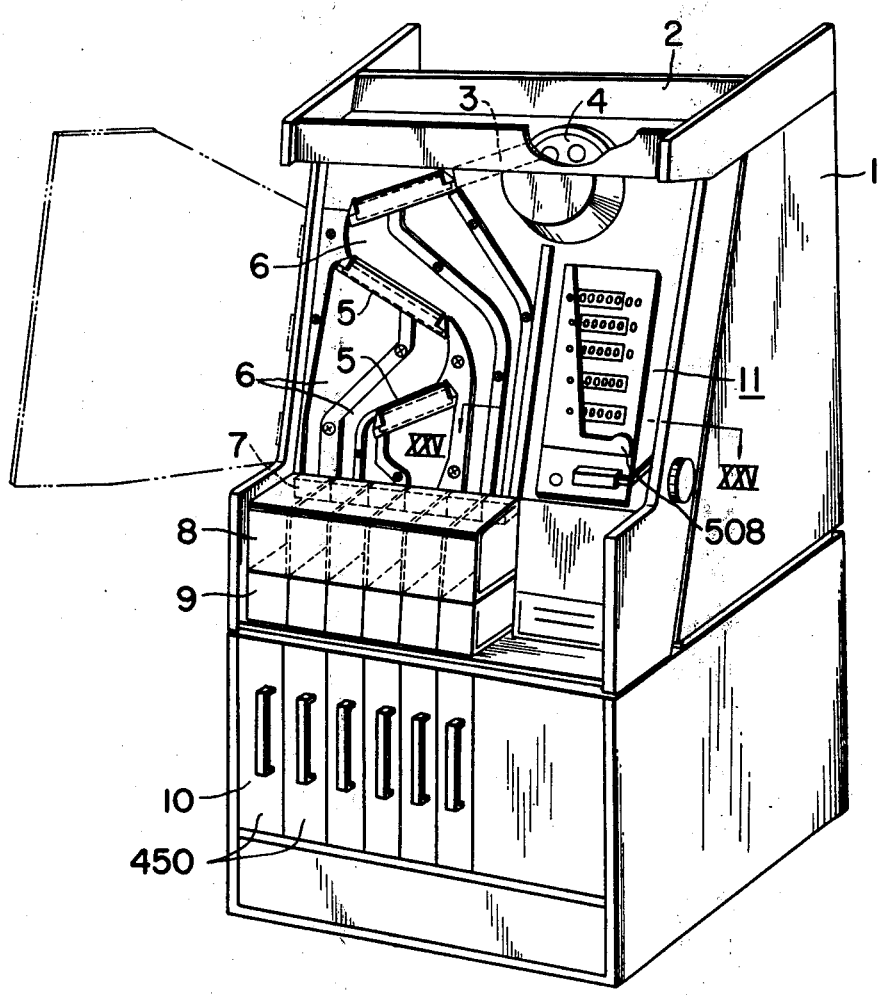
FIG. 1 is a perspective view showing one example of a coin classifying and counting machine according to the invention.
Figure 23:
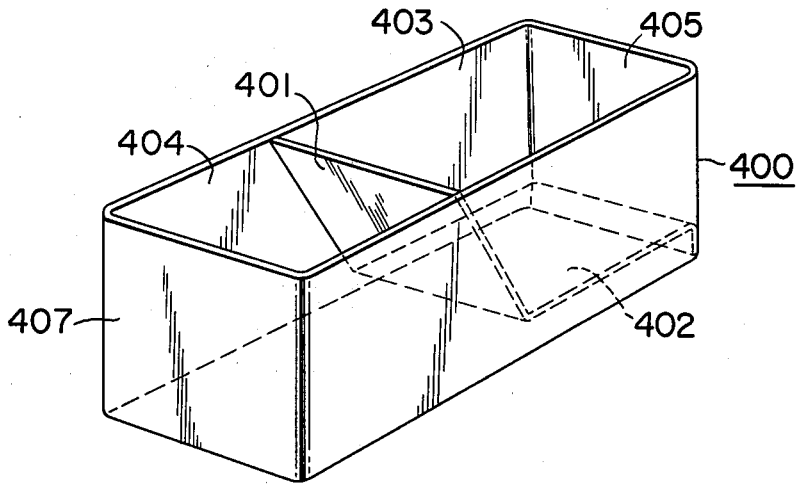
Figure 23:
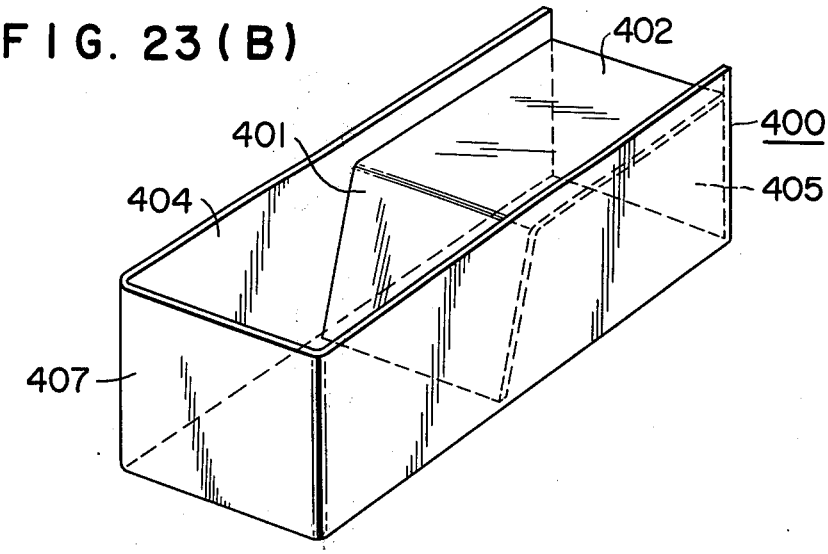
Figure 24:
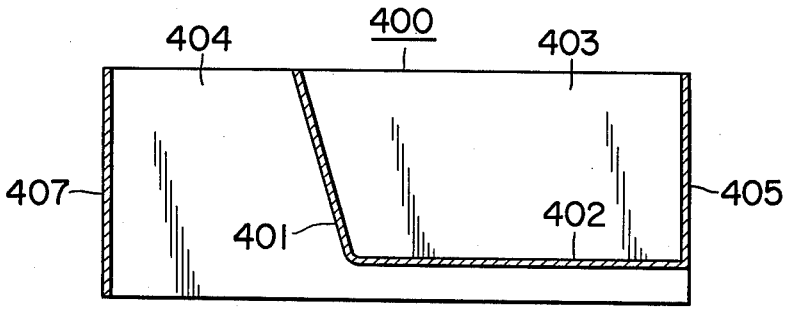
Figure 25:
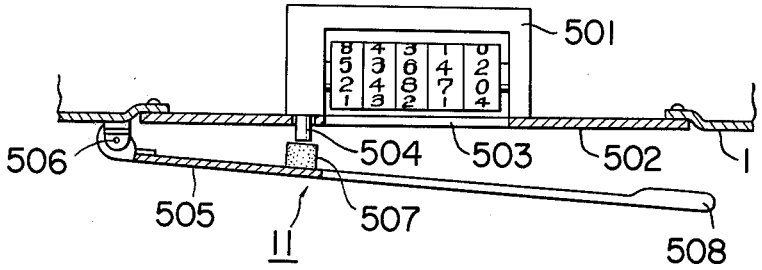
Figure 26:
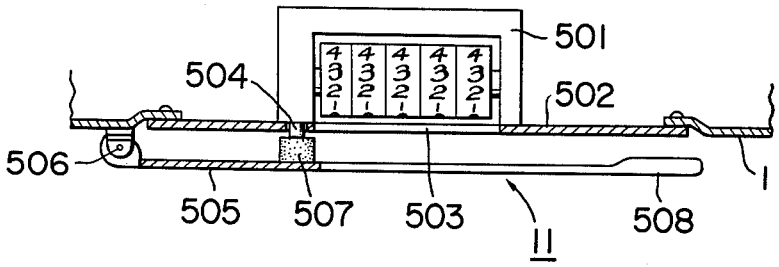
Figure 27:
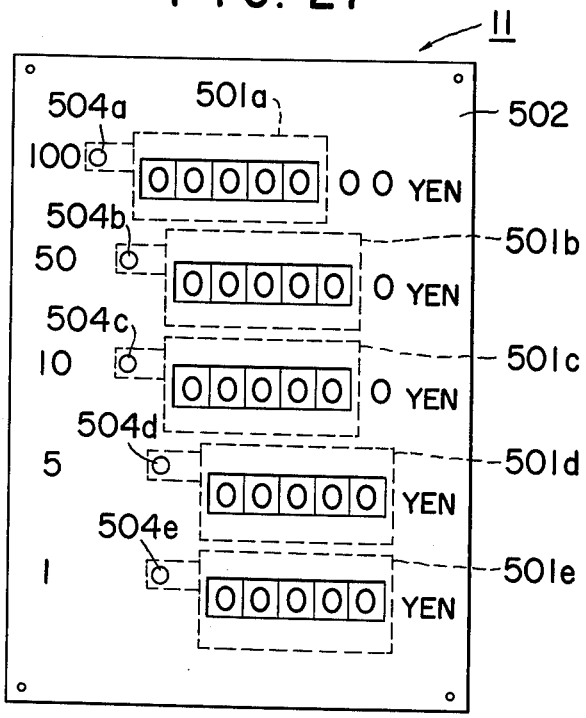
Figure 28:
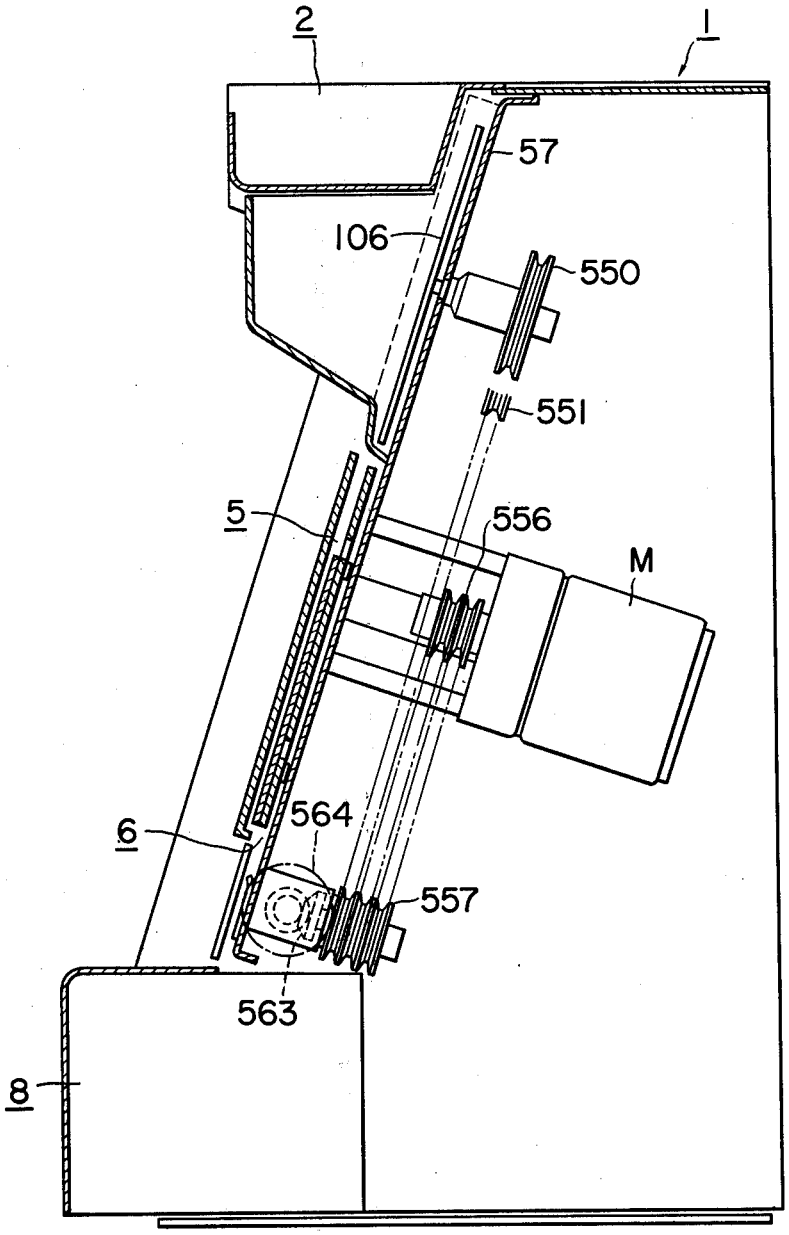
Figure 29:
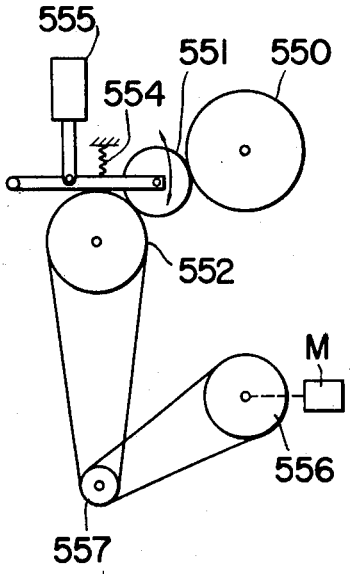
Figure 30:
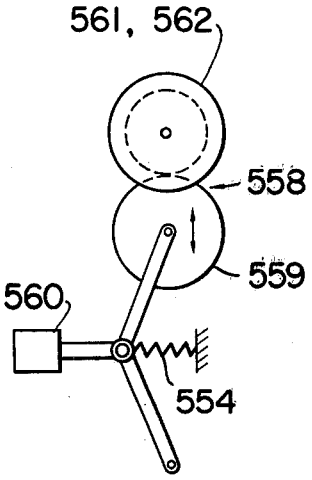
Figure 31:
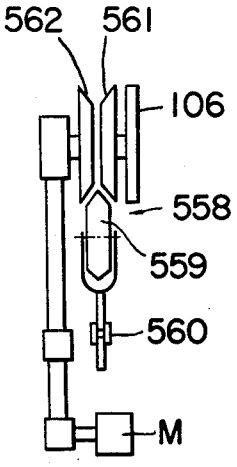
Figure 32:
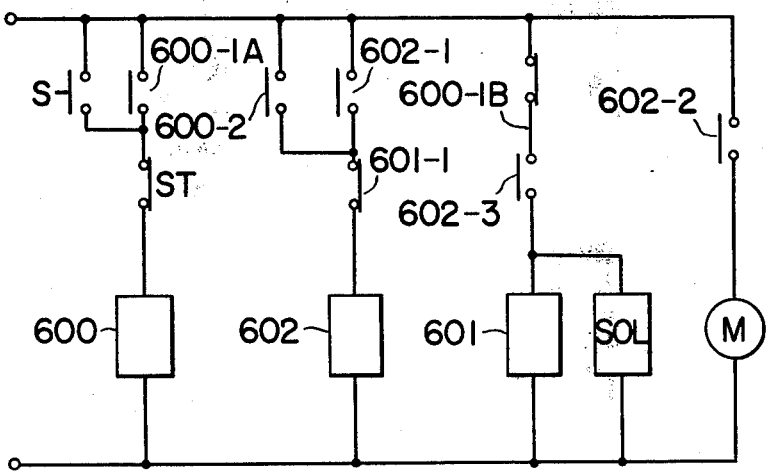

FIGS. 23(A) and 23(B) are perspective views respectively showing a coin take-out box for each coin kind as viewed from above and below;

FIG. 24 is a side elevation, in vertical section, of the coin take-out box shown in FIGS. 23(A) and 23(B);

FIG. 25 is a horizontal section taken along the plane indicated by line XXV — XXV in FIG. 1 and showing a part of an amount indicating device;

FIG. 26 is a section similar to FIG. 25, showing the part in a cleared (reset to zero) state;

FIG. 27 is a front elevation of the amount indicating device;

FIG. 28 is a side elevation, partly in vertical section, showing an essential part of the machine shown in FIG. 1;

FIGS. 29 and 30 are schematic diagrams for a description of a driving system;

FIG. 31 is a view of the mechanism shown in FIG. 30 as viewed from one side; and FIG. 32 is a circuit diagram illustrating one example of electrical wiring in the machine.

Throughout this disclosure, terms such as "front", "rear", "right", and "left" descriptive of directions correspond to those of the machine as viewed by an operator standing in his operational position and facing the machine. For example, the "front" part of the machine is that part thereof nearest the operator.

DETAILED DESCRIPTION

General outline

Referring to FIG. 1, the example of a coin classifying and counting machine according to this invention illustrated therein has a machine body 1 provided at the upper part thereof with a mixed coin collector or hopper section 2. A coin delivery device 4 of revolving disc type is provided within the hopper section for scooping up mixed coins and sending them out, one by one, into a delivery passageway 3. This delivery passageway 3 communicates with a plurality of sorting passageways 6 of undulating shapes having sorting devices 5, for sorting coins arranged successively at intermediate parts thereof.

Passageways are provided for passage therethrough of respective kinds of coins sorted by denomination by the sorting devices 5 and are provided at their lower ends with respective counting devices 7 for counting the coins of respective kind. A coin receiver section 8 for receiving sorted coins is provided downstream from the counting devices. Below this receiver section 8, a coin take-out space section 9 is provided, and a coin till-drawer section 10 is provided below the take-out space section 9.

Furthermore, an amount indicating device 11 for indicating the counted number of each kind of coin as a monetary amount is provided on a front panel of the machine body 1.

The above enumerated principal parts of the machine will now be described in detail.

Mixed coin hopper section 2

(Ref. FIGS. 2 through 8)

A coin collector vessel 50 molded from a synthetic resin is disposed in a manner to cover the above mentioned coin delivery device 4 and comprises a mounting flange 51 of annular shape loosely fitted around the outer a periphery of a revolving disc 106, described hereinafter, and a collecting funnel part 53 of semicylindrical shape projecting forward from the mounting flange 51 and having an upper coin inlet opening 52.

The mounting flange 51 is provided on its surface for contacting an inclined plate with a plurality (two in the instant example) of fixed pins 54, and one movable pin 55 projecting from the surface. Each of the fixed pins 54 has a stem part 54*a* and a head part 54*b* of greater diameter than the stem forward at the outer end of the stem. The movable pin 55 extends through the mounting flange 51 and is subjected to the force of a built-in spring 56 continually urging the pin in the direction for projecting its tip outward (rearward) from the flange. The other end of the movable pin 55 projects out from the outer (front) face of the flange 51 and is provided with a knob 55*a*.

Fixed pin attaching holes 58 and a movable pin insertion hole 59 are formed at positions corresponding to the fixed pins 54 and the movable pin 55, respectively, in an inclined plate 57 disposed around the periphery of the revolving disc 106. Each of the holes 58 has a large-diameter part 58*a* for insertion thereinto of the head 54*a* of the corresponding fixed pin 54 and a small-diameter part 58*b* for receiving the stem 54*a* of that fixed pin but not permitting the head 54*a* to pass out therethrough. The hole 59 for insertion thereinto of the movable pin 55 is formed at a position confronting the movable pin 55 when the stems 54*a* of the fixed pins 54 have been thus received in the small-diameter parts 58*b* of the holes 58, 58. Accordingly, when these pins are all fitted into their respective holes, the coin collector vessel 50 is mounted on the inclined plate 57 with its coin inlet opening 52 directed upward.

A trough cover 60 is disposed above the coin collector vessel 50 and functions as a coin receiving box for increasing the quantity of mixed coins which can be accommodated at one time and also as a cover for covering and sealing the top of the machine body 1. This cover 60 is hinged at its rear part on the machine body 1 and has a coin-drop opening formed in the bottom 62 of its trough 61 and positioned directly above the coin inlet opening 52 of the coin collector vessel 50. The bottom 62 is also provided with dust discharging holes 63, 63, . . . of a size which will not permit escape of the smallest coin.

The above described parts of the machine operate in the following manner.

Mixed coins are dumped into the trough 61 of the cover 60 and caused to drop through the inlet opening 52 of the coin collector vessel 50 into the collecting funnel part 53. Then, a main switch (not shown) is closed to start a motor M, the output of which is transmitted by way of a main shaft 100 and a clutch 103 to rotate a rotating head 104, whereby the above mentioned revolving disc 106 mounted on the head 104 rotates and scoops up the coins one-by-one with its coin receiving parts 107 from within the collector vessel 50 and sends these scooped coins into the delivery passageway 3.

The coins thus sent into the delivery passageway 3 are sorted by denomination according to characteristic features such as coin diameter by the sorting devices 5 in the sorting passageways 6. The coins thus sorted then pass through passageways of their respective kind to their respective counting devices 7, where they are counted, and are then sent to the receiver section 8.

An advantageous feature of the above described mechanism is that, in the event of jamming or clogging of coins between a coin scooping part 107 of the revolving disc 106 of the delivery device 4 and the inclined plate 57 or at the entrance of the delivery passageway 3 during the above described operation, the coin collector vessel 50 can be readily dismantled in the following manner.

The cover 60 is first swung upward, and then the knob 55*a* of the movable pin 55 is grasped and pulled outward to extract its tip from the hole 59 in the inclined plate 57. Then, the collector vessel 50 is rotated clockwise as viewed in FIG. 3, whereupon the movable pin 55 extracted from the hole 59 abuts and slides against the inclined plate 57, and the stems 54*a* of the fixed pins 54, slide out of the small-diameter parts **58*b* of the mounting holes 58 into the large-diameter parts 58*a*. The heads 54*b* of the fixed pins 54, can then be extracted out of their respective holes 58, whereby the collector vessel 50 can be removed from the machine body 1. Accordingly, the revolving disc 106 can be taken off, and work such as inspection of the entrance of the delivery passageway 3** can be easily carried out. Therefore, remedial measures for trouble such as clogging can be readily effected in minimum time.

For reassembly after such corrective measures have been effected, the fixed pins 54 of the collector vessel 50 are inserted into the large-diameter parts of the holes 58, and then the collector vessel is turned counterclockwise, whereupon the stems **54*a*, 54*a*, of the pins 54 are shifted to the small-diameter parts 58*b* and the heads 54*b* are engaged with the reverse side of the inclined plate 57 and are thereby prevented from being extracted. With the collector vessel 50 and are fixed pins 54 in this state, the movable pin 55 is thrust by the force of the spring 56 into the hole 59, whereby the pins 54 are prevented from shifting to the large-diameter parts 58*a* of their holes 58, and the collector vessel 50 is thus locked in position. The cover 60** is then swung into normal, closed position, and the operation of the machine can be resumed.

Thus, in accordance with this invention, the coin collector vessel, into which mixed coins are fed, is adapted to be dismantled in a simple manner from the machine body and, moreover, to be restored in a simple manner, whereby remedial measures can be readily effected in cases of trouble such as jamming or clogging of coins in the coin delivery device or at the entrance of the coin delivery passageways, and the overall work efficiency can be greatly improved.

Coin delivery device 4

Figure 2:
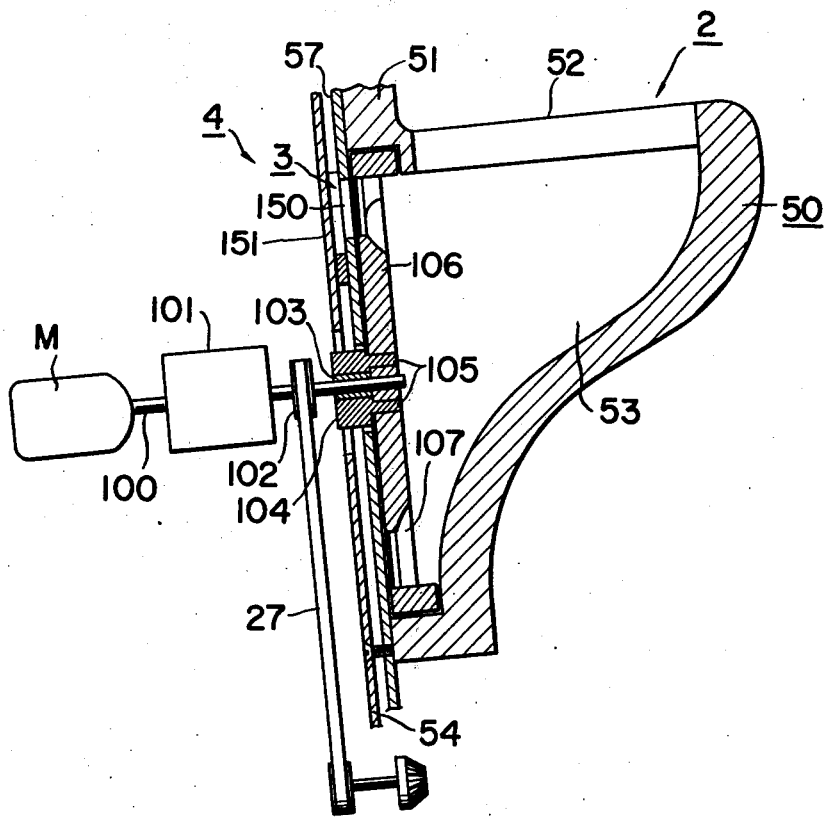
FIG. 2 is a side elevation, partly in vertical section, of a mixed coin collector or hopper.
Figure 3:
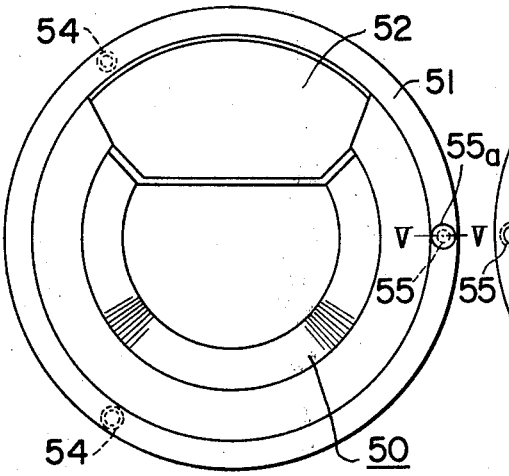
FIGS. 3 and 4 are respectively front and rear elevations of a coin collecting structure.
Figure 4:
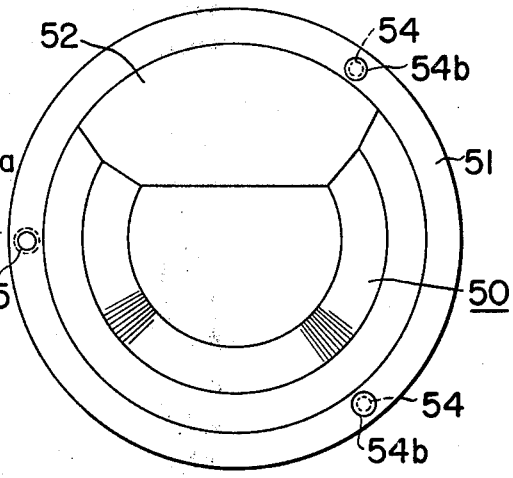
Figure 5:
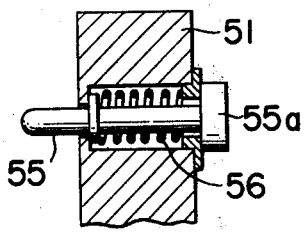
FIG. 5 is an enlarged section taken along the plane indicated by line V—V in FIG. 3.
Figure 6:
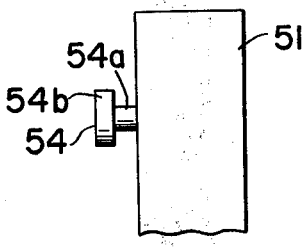
FIG. 6 is an enlarged side view showing a fixing pin.
Figure 7:
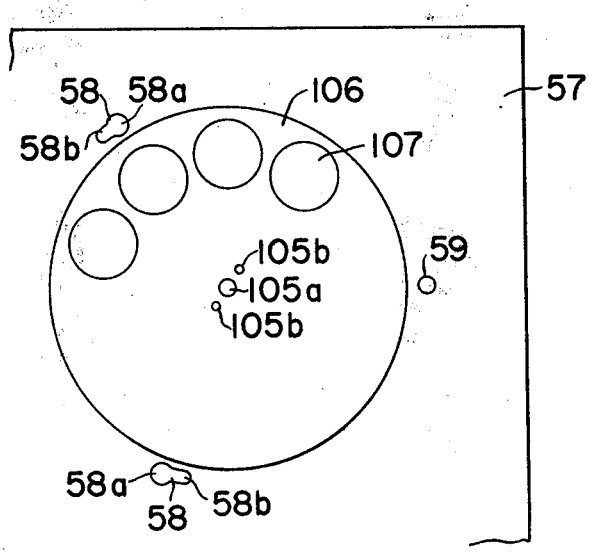
FIG. 7 is a front elevation showing the arrangement of mounting holes on the side of the coin classifying and counting machine.
Figure 8:
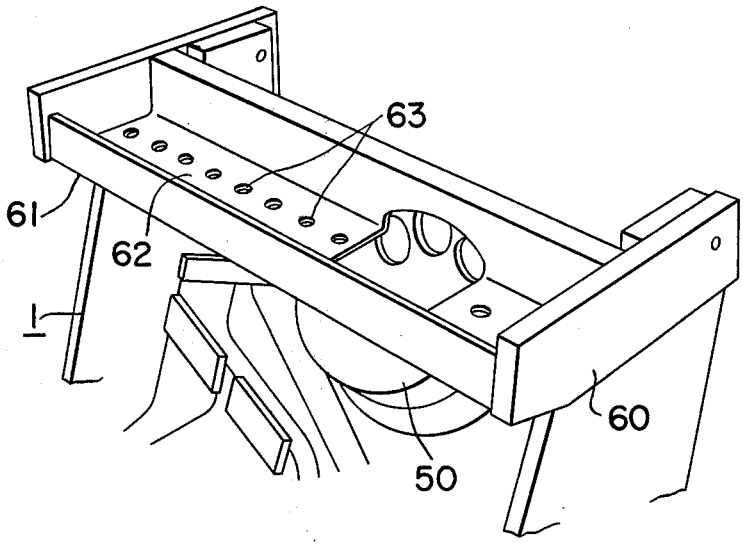
FIG. 8 is a perspective view is a perspective view of a cover part.
Figure 10:
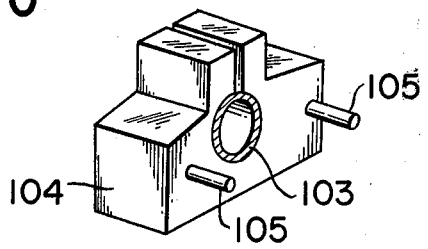
FIG. 10 is a perspective view of a rotating head.

(Ref. FIGS. 2 and 10)

As shown in FIG. 2, in the coin delivery device 4, the motor M is disposed at a position to the rear of the upper part of the inclined plate 57 having the sorting passageways 6 formed on its front face. On the main shaft 100 of this motor M a gear head 101 functioning additionally as a bearing and a pulley 102 are supported, and at the front end of the main shaft, the rotating head 104 is fitted over the resin clutch 103 interposed therebetween.

The main shaft 100 and the rotating head 104 extend through the inclined plate 57. A pair of pins 105 are fixed to and project forward from the rotating head 104. A pair of corresponding holes formed in the central part of the revolving disc 106 for taking out coins from the mixed coin hopper section 2 respectively receive these pins 105, 105 inserted thereinto.

As mentioned brieflfy hereinbefore, the revolving disc 106 has a plurality of coin receiving parts 107. These scooping parts are in the form of circular holes positionally arranged in the form of a ring at spaced apart positions suitable for sending scooped up coins into the delivery passageway 3. Each of these scooping parts has a diameter which is amply large for scooping and accommodating the coins of maximum diameter that are to be sorted. On the inner peripheral surface of each coin receiving part 107, there is formed a scooping part 108 of sufficient thickness whereby it is capable of scooping a plurality of coins when these coins are overlappingly piled and a single-coin holding part 109 having a thickness somewhat thinner than that of a single coin and operating to drop the plurality of coins thus scooped up by the scooping part 108, except for a single coin, into the mixed coin hopper section 2.

Figure 11:
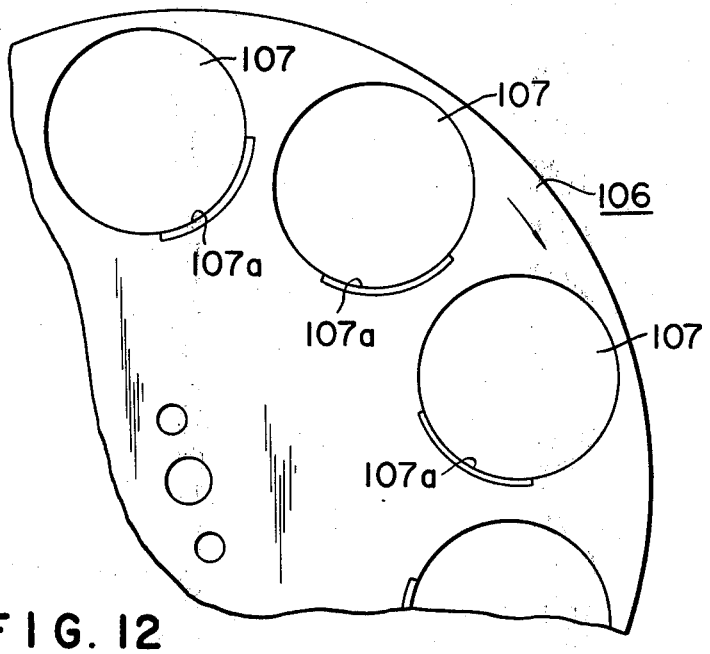
FIG. 11 is an enlarged, fragmentary, front view of one part of the revolving structure.

The revolving disc 106 has a central flat part 110 provided with projections 111 for agitating the mixed coins and a rib or bead 112 for reinforcement formed around the outer periphery thereof. On the reverse face of the revolving disc 106, a portion of the single-coin holding part 109 on the reverse side of the scooping part 108 is cut away, as indicated in FIG. 11, and a slide-drop part **107*a* is formed to facilitate the dropping of the single coin to the reverse side of the revolving disc 106**.

The coin delivery device of the above described construction operates as follows. The main switch (not shown) is closed to start the motor M, whereupon the output of the motor M is transmitted through the main shaft 100 and the clutch 103 to the rotating head 104. As a result of the rotation of the rotating head 104, the revolving disc 106 is also rotated by the pins 105 as its projections 111 agitate the mixed coins accommodated within the hopper section 2. During this rotation, the projection 111 function to rectify the coins which have not yet been aligned in parallel to the revolving disc 106. Consequently, the coins are scooped smoothly by the coin receiving parts 107 moving through the lower region of the mixed coin hopper section 2. In the instant example, this scooping of coins is accomplished with two coins in overlapped state.

Figure 9:
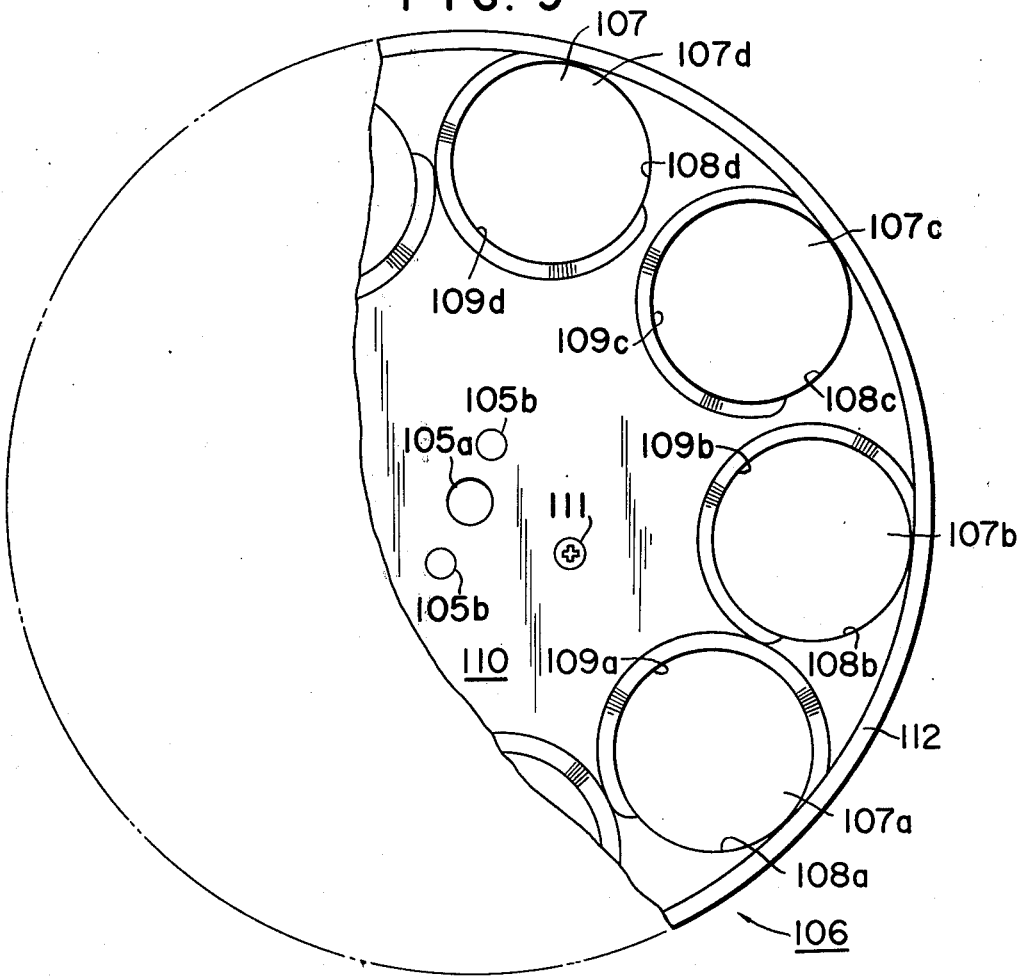
FIG. 9 is a planar view, with a part cut away, showing one example of a revolving structure.

More specifically, two coins in superimposed state which have scooped by the scooping part **108*a* of, for example, a receiving part 107*a* as indicated in FIG. 9 are conveyed upward by the rotation of the revolving disc 106 and, passing through the state of a receiving part 107*b*, reach the position of a receiving part 107*c*. Since at this position the two superimposed coins are positioned on the single-coin holding part 109*b* of small thickness, one of the two coins becomes unsupported and drops toward the coin hopper section 2, and only a single coin is left. The revolving disc 106 is rotated with only this single coin present until the coin reaches the position of the receiving part 107*d*, where this coin is dropped toward the delivery passageway 3**.

However, if the superimposed coins from the single-coin holding part 109 are not reduced in number to a single coin but are sent as they are to the delivery passageway, the coins will be forced into the space between the revolving disc 106 and the inclined plate 57. In such an event, an abnormal load will be imposed on the revolving 106, and the rotating head 104 will be stopped. However, since the clutch 103 is interposed between the main shaft 100 and the rotating head 104, undesirable results such as damage to the device, seizure of the motor M, and breakage of a belt 27 for counting are prevented.

Moreover, since the clutch 103 in preventing such damage undergoes no displacement whatsoever in the thrust direction of the main shaft 100, the revolving disc 106 merely stops rotating relative to the inclined plate 57 and undergoes no change on the hopper section side, and the coins which have already been scooped do not drop into the space between the revolving disc 106 and the inclined plate 57. Furthermore, even if the above mentioned delivery of superimposed coins occurs during normal sorting operation, the belt 27 for driving the counting devices is not stopped, and, therefore, the counting of the coins which have already been delivered is not affected.

It should be understood that, while the above-mentioned clutch 103 is of a type which is provided around the peripneral surface of the main shaft 100, this invention is not limited to a clutch mechanism of this character, it being possible to utilize a clutch mechanism of any other suitable type. One example is a clutch mechanism in which a rotating head is mounted rotatably on a back plate and supports a clutch plate fixed thereto and confronting a counterpart clutch plate fixed to the main shaft, slippage occuring between the two clutch plates when an excessive load is imposed on the head side.

Another feature of this coin delivery device according to this invention, in addition to the above described prevention of damage by the clutch mechanism, is that miscounting cannot occur since the belt for counting is running even when there is clogging of coins. Furthermore, clutch operation can be carried out without displacement in the thrust direction relative to the main shaft. For this reason, undesirable occurrences such as dropping of coins which have already been scooped up on the reverse side of the revolving disc are abuiated.

Still another feature of this device is that, in the case where the coin delivery device 4 is to be cleaned or the revolving disc 106 is to be replaced after the sorting and counting operations, the work can be carried out by dismantling the revolving disc 106 from the rotating head 104 after first removing the hopper section 2 attached by means such as screws to the inclined plate 57.

Accordingly, in the case of replacement, by standardizing the eccentric position of a pin insertion hole **105*b* relative to a central hole 105*a*** for all kinds of revolving discs, the operations of sorting and counting of a large number of kinds of coins with a single device can be accomplished in a very simple manner.

As described above, in accordance with this invention, the main rotating shaft and the revolving disc are not made integral but are made separate, and, moreover, both are adapted to be readily attachable and detachable. As a result, in the coin sorting and counting device, which is required to possess the mutually conflicting characteristics of accuracy and high operation speed, changing of the revolving disc to that for sorting other kinds of coins and cleaning of the device are greatly facilitated.

Furthermore, as a result of the structural feature wherein the outer periphery of the above described revolving disc is encompassed and covered by the concave part of the inner side of the coin hopper section, the operation of this revolving disc is made positive and accurate, and the above mentioned mutually conflicting characteristics can be attained. Moreover, accurate sorting and counting operation can be carried out without the installation of any separate device in the conventional machine, whereby great advantages in economy and structure are attained.

Delivery passageway 3

A coin outlet opening 150 is formed in the inclined plate 57 at a position thereof corresponding to a scooping part 108 positioned at the upper part of the above described revolving disc 106, and the coin delivery passage 3 is formed on the rear side of this outlet opening and extends laterally to the left.

Figure 12:
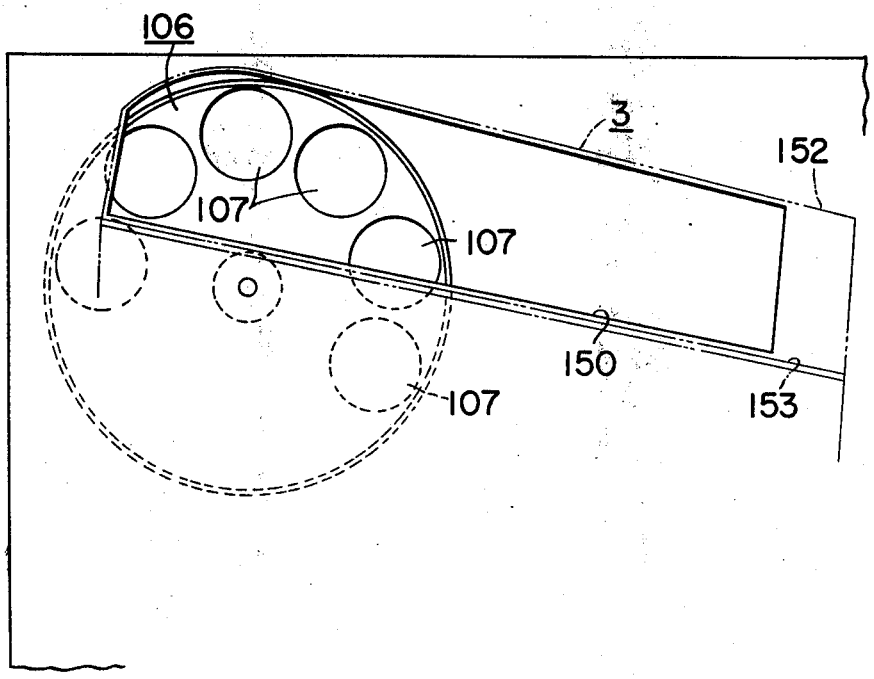
FIG. 12 is a rear elevation of the part illustrated in FIG. 2 as viewed from the left.

In the instant example, this coin delivery passageway 3 is formed by a coin holding plate 152, which is formed integrally with a swinging plate 151 provided in a swingable manner on the rear side of the inclined plate 57 and having coin sorting devices, and which, forming the passageway 3, functions to support one face of each coin passing therethrough and by a rail 153 fixed to this coin holding plate 152 along the lower edge part thereof. As shown in FIG. 12, the rail 153 is disposed on the rear side of the revolving disc 106 and extends over an extent such as to cover a number of scooping parts 107, and the coin holding plate 152 is also extended to at least the extent of the rail 153.

The swinging plate 151 is hinged at its edge to the rear upper part of the inclined plate 57. When this swinging plate 151 is in closed position, it functions cooperatively with the above mentioned coin holding plate 152 to form the delivery passageway 3 and, moreover, forms the sorting passageways 6 contiguously following the delivery passageway 3.

The structure of this delivery passageway 3 is not limited to that described above and illustrated in the drawings. For example, an arrangement in which a coin holding plate 152 of only the delivery passageway 3 is provided separately of the swinging plate 151, and only this part of the delivery passageway 3 is adapted to open and close to make it possible for coins jamming or clogging the passageway 3 to be discharged may be used.

In the case of the instant example, when the swinging plate 151 is swung rearward about its hinge line, any coins within the passageway 3 are discharged toward a discharged coin collector. This feature is provided for the purpose of discharging clogging coins when there is clogging within the delivery passageway 3 or when there is clogging between the revolving disc 106 and the passageway 3.

The coin delivery device 4 of the above described construction according to this invention operates as follows.

When the main switch (not shown) is closed to start the motor M, the power of its output shaft 100 is transmitted by way of the clutch 103 to rotate the rotating head 104, whereupon the revolving disc 106 coupled by the pins 105 to this rotating head 104 is rotated and, stirring the mixed coins dropped into the mixed coin hopper section 2, scoops up a number of coins by the scooping part **107*a* of the receiving part 107**.

The coins thus scooped move progressively to and are supported by the part **107*b* of thin dimension for holding a single coin as the revolving disc 106 revolves. Surplus coins at this time slide down into the hopper section 2** and are thus recovered.

When the coin receiving part 107 holding a coin as described above rises, as the revolving disc 106 revolves, and reaches a position confronting the coin delivery passageway 3, the coin has shifted to the position of the slide-drop part **107*c* of the coin receiving part 107 and thereupon slides and drops from this slide-drop part 107*c* to the rear side of the revolving disc 106**.

The coin which has thus dropped is received in the inlet part of the delivery passageway 3 and, rolling on and along the rail 153 of this passageway, is sent to a sorting passageway 6, for example.

If, during this operation, there should be clogging of coins on the side of the sorting passageway 6 or within the delivery passageway 3, which thereupon becomes filled with coins, the coins successively scooped up by the receiving parts 107 of the revolving disc 106 can no longer slide and drop into the delivery passageway 3 and, therefore, will all be collected in the coin hopper 2 and will not be delivered uselessly. Accordingly, when a certain number of coins are contained within the delivery passageway 3, additional coins cannot be crammed thereinto, and there is little possibility of undesirable occurrences such jamming or forcible entrance and scattering of coins.

For discharging coins which are clogging the coin travel path, the swinging plate 151 is swung open, whereupon the coin holding plate 152 is also opened, whereupon the coins within the delivery passageway 3 drop downward and can be collected by suitable means (not shown). By adopting an arrangement as in the instant example wherein the swinging plate 151 is used commonly for the sorting passageways 6 and the delivery passageway 3, coins within the delivery passageway can be discharged at the same time.

A feature of this invention, as described above, is that the delivery passageway 3 is disposed to extend in a manner to be superposed with the coin scooping part 107 at the upper rear region of the revolving disc 106, and the coins scooped up by the revolving disc are sent successively and continuously into the delivery passageway. Accordingly, the coin delivering operation to the delivery passageway is carried out rapidly and positively, and the coin delivery speed can be remarkably increased.

Another noteworthy feature of the invention is that, in the event of jamming or clogging of coins in the delivery passageway or a part downstream therefrom, the delivery of coins thereafter is interrupted as a natural consequence. Therefore, without the provision of a special stopping mechanism, forcible insertion or wedging and scattering of coins are prevented. Furthermore, since the coin holding plate constituting one wall of the delivery passageway is of an openable and closable construction, discharging of coins in the event of coin clogging can be carried out in a simple manner.

Coin sorting

Figure 13:
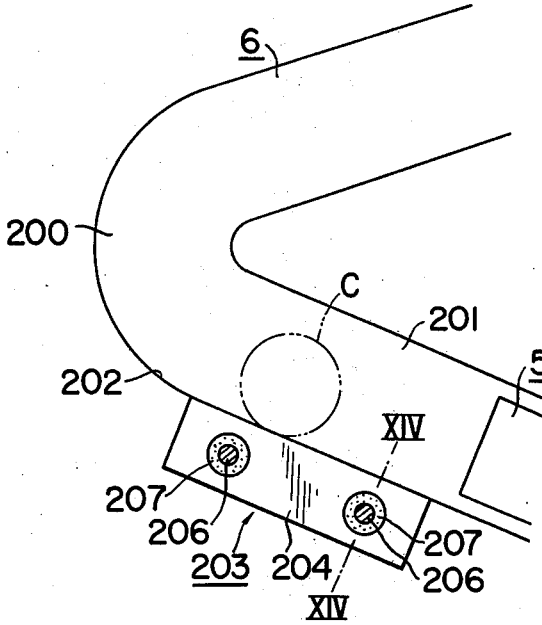
FIG. 13 is an enlarged, fragmentary, front elevation of a part of a sorting passageway.

As shown in the enlarged fragmentary view of FIG. 13, a shock-absorbing device 203 is provided at the bottom wall 202 of the downstream passageway 201 extending obliquely downward from a sharp bend 200 in the aforementioned sorting passageways 6.

This shock-absorbing device 203 is disposed at the upstream end of the passageway 201 downstream from the bend 200 and has a shock-absorbing member 204, which is so disposed that its upper surface forms a part of the bottom wall 202 of the passageway. The shock-absorbing member 204 is mounted on the swinging plate 151 by mounting screws 206 acting over retaining washers 205. Shock-absorbing structures 207 made of an elastic material such as a rubber material are interposed between the washers 205 and the shock-absorbing member 204, which is thereby elastically supported relative to the machine body 1.

Figure 14:
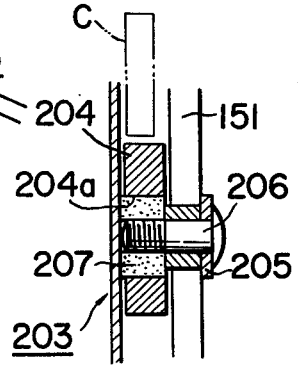
FIG. 14 is an enlarged section taken along the plane indicated by line XIV — XIV in FIG. 13.
Figure 15:
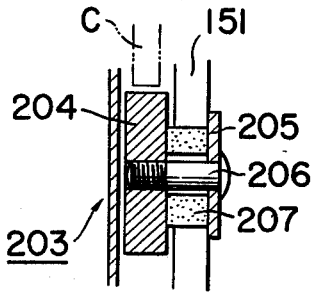
FIG. 15 is a section similar to FIG. 14, showing another example of construction.

This elastic supporting structure may be of a construction as illustrated in FIG. 14, for example, wherein a ring-shaped shock-absorbing structure 207 made of rubber is interposed between each mounting screw 206 and a respective through hole **204*a* formed in the shock-absorbing member 204 for receiving the screw. Alternatively, the construction may be as illustrated in FIG. 15 wherein each screw 206, itself, is supported by a shock-absorbing structure 207** comprising a ring-shaped structure of rubber. Still another alternative construction is that wherein the shock-absorbing member itself is formed from an elastic material.

Figure 16:
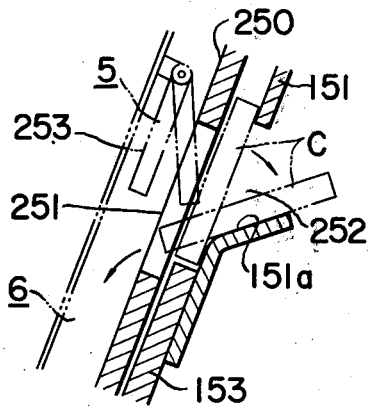
FIG. 16 is a sectional view showing one example of a sorting part.

One example of a sorting device 5 as illustrated in FIG. 16 is made up, essentially, of an inclined plate 250 having a window opening 251 formed therein and the swinging plate 151 disposed behind this opening 251. This swinging plate 151 is provided with a sorting opening 252 formed with a height corresponding to the diameter of a coin C to be sorted. This sorting opening 252 has a lower edge **151*a* which is inclined rearward, whereby the coin C slides and falls as indicated by an arrow along this inclined edge 151*a* from the window opening 251 of the inclined plate 250 into the passageway 6 leading to the coin receiver section 8**.

Since a shock-absorbing member 204 is provided in the bottom wall 202 of the passageway 201 downstream from the sharp bend 200 in the coin sorting passageway 6, the rolling coin C upon sharply turning at the sharp bend 200 strikes against the shock-absorbing member 204, by which the impact is absorbed, and any acceleration of the coin is damped, the coin thereby rolling along the passageway 201 without irregular rolling. Accordingly, the coin C rolls on without bouncing on the rail 153, and positive sorting is possible.

Figure 20:
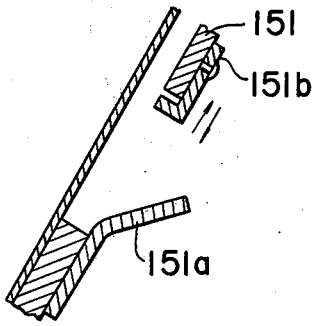
FIG. 20 is a sectional view showing another example of the sorting part illustrated in FIG. 16.

In a modification, as illustrated in FIG. 20, of the above described sorting device, an adjustment member **151*b* is mounted in a manner permitting its upward and downward adjustment below the upper edge of the sorting opening 252. This adjustment member 151*b*** is thus adjusted in accordance with the diameter of the kind of coins to be sorted and then set securely in position.

In the event that coin clogging occurs in some part such as the coin sorting section or in the delivery passageway, and the swinging plate 151 is opened, the swinging plate 151 is moved in a direction away from the inclined plate 250, and the clogging coins and the coins in the delivery passageway and the sorting passageways are returned to a returned coin box. For this purpose, the swinging plate 151 is opened by means of a lever 359, at which time, a gate plate 253 moves from its position indicated by single-dot chain line to the position indicated by the two-dot chain line in FIG. 16 thereby to prevent the coins from entering the passageway 6.

When the swinging plate 151 is returned to its position indicated in FIG. 16, the gate plate 253 returns to its position indicated by single-dot chain line.

Coin counting section

Figure 17:
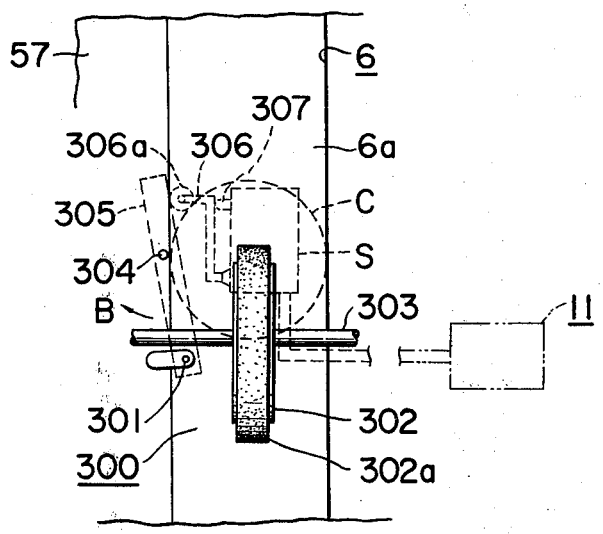
FIG. 17 is a front elevation showing one example of a counting device.
Figure 18:
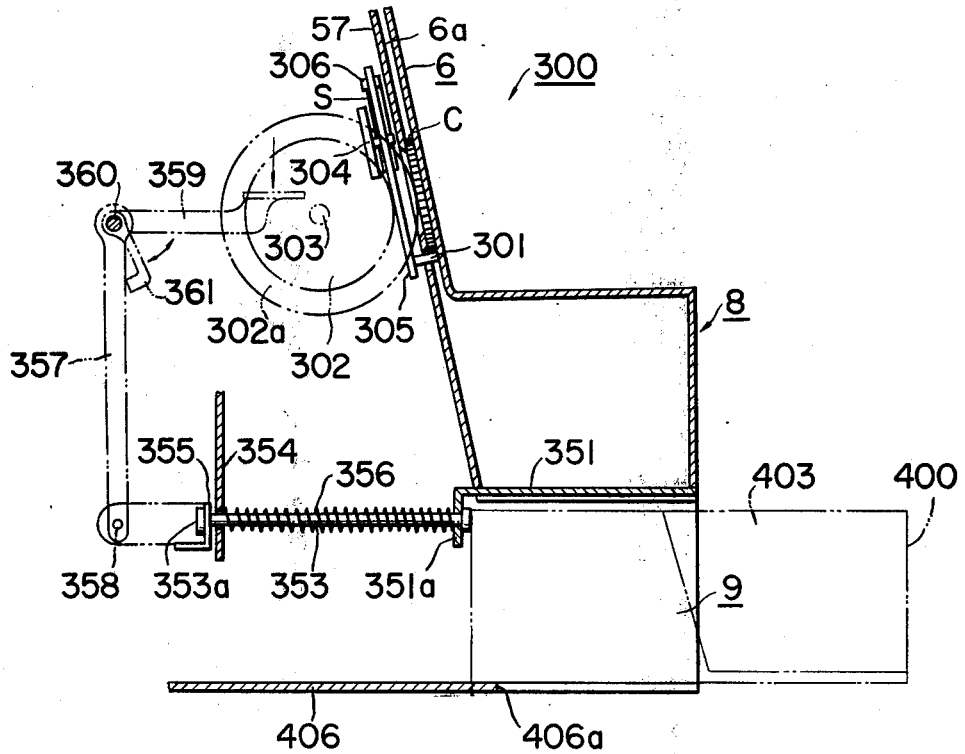
FIG. 18 is a side elevation of the counting device shown in FIG. 17.

As shown in FIGS. 17 and 18, the coin counting devices 7 according to this invention are provided at the outlet ends of respective sorting passageways 6 for respective kinds of coins sorted by the coin sorting devices 5. Each coin counting device 7 is provided with a coin moving device 300 for pressing against one face of each coin C traveling through the corresponding passageway 6 thereby to move the coin along its travel path, an actuation pin 301 contacted and actuated by a coin C in the course of being thus moved by the coin moving device 300, and a coin counting switch S activated by the movement of the actuated actuation pin 301 transmitted by way of a transmission mechanism.

The above mentioned coin moving device 300, in the illustrated example, comprises a driving roll 302 having a peripheral surface **302*a* formed from a material of large coefficient of friction such as rubber. Each roll 302 is so disposed that its peripheral surface 302*a* confronts the opposite wall surface 6*a* of the corresponding sorting passageway 6 with a gap distance therebetween which is somewhat less than the thickness of one corresponding coin. All rolls 302 are mounted on a common horizontal shaft 303, which is driven by power transmitted through means such as an endless belt from the motor for driving the aforedescribed coin delivery device 4**, and which is thus rotated at constant speed in the direction of the arrow A.

The above mentioned actuation pin 301 is fixed to one end of a swinging lever 305 pivotally supported by a shaft 304 and projects into the sorting passageway 6 on one side of the passageway wall 6*a*. This mechanism is so adapted that when a coin C sent downward by the roll 302 strikes against the actuation pin 301 as indicated in FIG. 18, the swinging lever 305 swings in the direction of arrow B in FIG. 17 about its pivot shaft 304.

The tip 306*a* of an actuation member 306 of the counting switch S contacts the other end of the swinging lever 305, and the actuation member 306 is disposed at a position where it can press against a switch member 307 of the counting switch S. Accordingly, the above mentioned swinging movement of the swinging lever 305 is transmitted by way of the actuation member 306 to press the switch member 307 to actuate the counting switch S to its ON state. The number of coins counted by the counting switch S is additively indicated by the amount indicating device 11, which indicates the counted number for each kind of coin. The coins of each kind thus counted are accumulated in the corresponding receiving chamber 350 of coin receiver section 8 disposed below the counting devices 7.

The coin counting devices 7 of the above described structural organization operate as follows.

Mixed coins dumped into the mixed coin hopper 2 are delivered by the coin delivery device 4 into the delivery passageway 3 and are then fed into the sorting passageways 6 and sorted by kind of coin by the coin sorting devices 5 as described hereinbefore. The coins C thus sorted by kind by the sorting devices 5 are sent respectively into the passageways 6, each of which is for a single kind of coin, and thereafter travel through these passageways toward the receiver section 8.

When each coin C reaches the counting device 7 according to the invention installed in the sorting passageway 6 immediately upstream from the receiver section 8, the coin C enters the space between the passageway wall surface 6*a* and the peripheral surface 302*a* of high frictional coefficient of the roll 302 and is sent downward at a constant speed by this roll 302 continually rotating at a constant speed.

At an intermediate point along the path of the coin C thus sent downward, the edge of the coin strikes against and pushes the actuation pin 301, whereupon the swing lever 305 pivots about the shaft 304 in the arrow direction B shown in FIG. 17 and, at its other end, presses the actuation member 306, whereby the switch member 307 is pressed, and the counting switch S is turned ON. As a result, this count is indicated by the amount indicating device 11 for the corresponding kind of coin.

The above described operation is repeated for each succeeding coin of the same kind. At the same time, the same operation is carried out respectively for the other kinds of coins. The coins C which have been counted are stored in respective parts differentiated by kind of the take-out space section 9.

While, in the instant example, a driving roll 302 is used in the coin moving device 300, a coin moving device employing a driving belt of a material such as rubber may be used instead. Furthermore, the means for transmitting the movement of the actuation pin 301 to the counting switch S need not be limited to that described above, any other suitable mechanism being usable.

By the arrangement of each counting device as described above, each coin is counted as it is compulsorily sent along its path at constant speed irrespective of the weight of the coin. Accordingly, ther is no possibility of miscounting arising from deviations in the weight of the coins of each kind, and the counting switch is activated positively to generate positively counting signals.

Coin Collection Section

Figure 19:
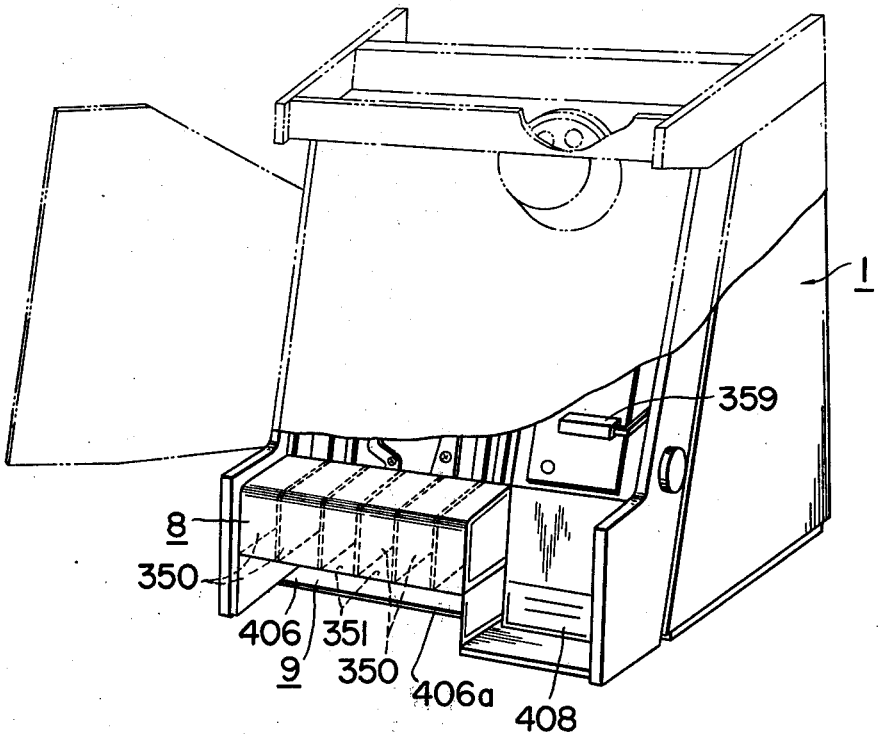
FIG. 19 is a perspective view similar to FIG. 1 but with a part thereof removed.
Figure 22:
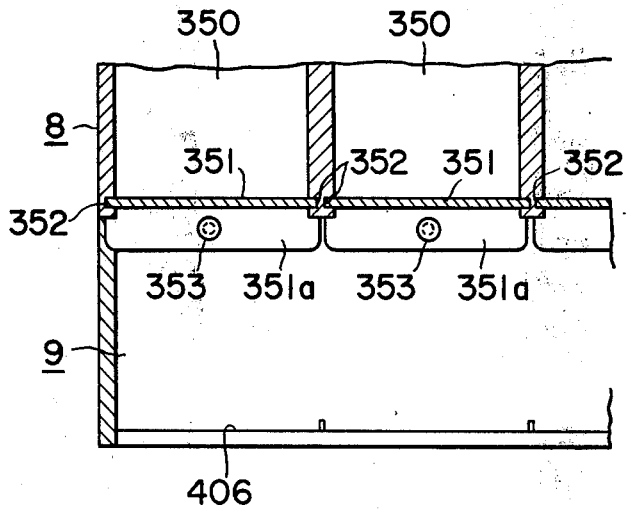
FIG. 22 is a fragmentary elevation, partly in vertical section of the parts shown in FIG. 21.

The coin receiving device 8 is provided, as best illustrated in FIG. 19, at the discharge ends of the coin classification passageways 6. The coin receiving device 8 comprises coin receiving chambers 350 of a number corresponding to that of the kinds of the coins to be handled, and a coin take-out space 9 having a specific height is provided below the coin receiving chambers 350, as shown in FIGS. 19 and 22. Each of the coin receiving chambers 350 is so formed that at least the top wall or the front wall, or both walls of the chamber 350 are made of a transparent material, so that the coins received within the chambers are visible from the outside. An opening is provided at the bottom of the chamber, and the opening is ordinarily closed by means of a shutter plate 351.

More specifically, a shutter plate 351 is received in guiding grooves 352 formed in the lower parts of both side walls of each chamber 350 in a manner such that the shutter plate 351 is slidable along the grooves 352 in the forward-and-rearward directions.

Figure 21:
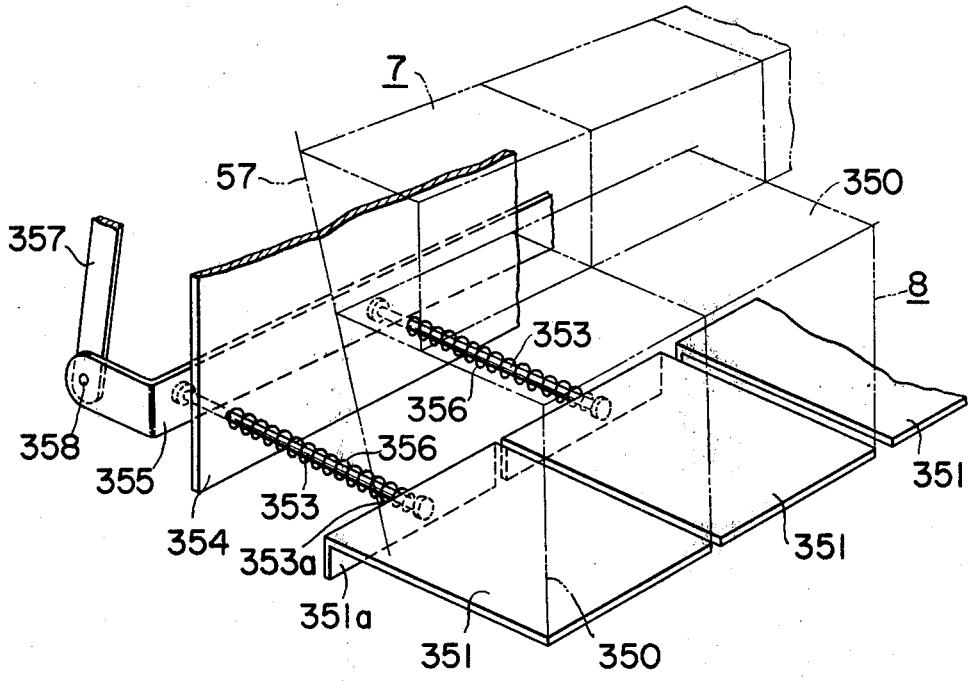
FIG. 21 is a fragmentary perspective view showing the relationship of shutter plates at the bottoms of receiving chambers.

The rear end of each of the shutter plates 351 is bent as indicated in FIG. 21 to provide a portion 351*a* projecting downwardly so that the portion 351*a* is engageable with a wall 407, which is not cut away, of a hereinafter described coin receiving box 400. The portion 351*a* is connected to the forward end 353*a* of a rod 353 extending horizontally through a structural frame 354 in a manner slidable in the axial direction, and a helical spring 356 is slipped over the rod 353 at a part thereof between the frame 354 and the portion 351*a*.

The rear ends of the rods 353, as viewed in FIG. 21, are in turn connected to an arm of an L-shaped connecting lever 355, and the other arm of the L-shaped lever 355 is coupled through a pin 358 to an end of a lever 357 swingable around a shaft 360 in cooperation with a handle 359 which is provided in the front part of the machine to activate an arm 361 when the handle 359 is depressed downwardly. The swinging movement of the lever 357 causes the connecting lever 355 to retract, and the shutter plates 351 are thereby shifted rearwardly to discharge the coins reserved in the chambers 350 downwardly.

In the above-mentioned coin take-out space 9 of a predetermined height provided below the coin receiving chambers 350, coin take-out boxes 400 are inserted in alignment with the chambers 350.

Each of the coin take-out boxes 400 has a width substantially equal to the width of the chamber 350 and a height insertable into the space 9. One half part, along the length, of the box 400 is formed into a coin receiving portion 403 defined by a separating wall 401, an end wall 405, and a bottom plate 402, and the other half part of the box 400 is formed into a coin passing framelike portion 404 having no bottom plate, as best illustrated in FIGS. 22 and 23.

Furthermore, the lower edge of an end wall 405 defining the coin receiving portion 403 is cut away as shown in FIGS. 23(A) and 24 so that the edge does not interfere with the movement of the downwardly projecting portion 351*a* of the shutter plate 351 in the case where the box 400 is reversely inserted in the space 9 as described hereinlater in more detail.

The coin take-out 400 may be inserted into the space 9, as shown in FIGS. 18, 19, and 22, in a manner such that the coin passing framelike portion 404 of the coin take-out box 400 comes just under a coin receiving chamber 350, and a substantial part of the box 400 is held forwardly of the forward edge 406*a* of the bottom plate 406.

Although it is not shown in the drawings, if it is required, another box having a height substantially equal to that of the coin take-out box 400, but a width covering the entire width of the coin take-out space 9, and a depth (in the forward-and-rearward direction) sufficiently greater than the depth of the space 9, may be provided, and this may be inserted in the space 9, so that all of the coins received in the coin receiving chambers 350 may be recovered in mixed condition in this box and returned again into the coin supplying hopper 2 for reclassifying the coins, when any faulty operation is found in the coin sorting device and the like.

Furthermore, a coin take-out port 408 is provided in the front panel of the coin handling machine 1 for recovering cons when any clogging occurs in the coin sorting passageways.

Referring back to FIG. 1, a till-drawer section 10 is further provided below the coin take-out space 9, and till drawers 450 are provided therein in vertical alignment with the respective coin receiving chambers 350, so that coins thus sorted and received in the coin receiving chambers 350 and found to be without fault, are passed into the corresponding till drawers 450 under the action of the handle 359 and stored therein until the user of the machine takes out these sorted coins.

The coins C thus sorted and counted their number are temporarily stored in the coin receiving chambers 350. Since the chambers 350 are partly or in entirety made of a transparent material as described above, the number of coins stored therein and, furthermore, whether other kinds of coins are mixed or not can be confirmed by observation from outside.

In the case where it is desired to take the coins C in one of the chambers 350 out of the chamber, a coin take-out box 400 is inserted in the space 9 under the chamber 350 in a manner such that the end wall 407 comes first and the coin receiving portion 403 opens upwardly. In this case, the end wall 407 of the box 400 abuts against the bent down portion 351*a* of the shutter plate 351 and pushes the bent down portion 351*a* rearwardly against the force of the spring 356, thereby opening the shutter plate 351 at the bottom of the coin receiving chamber 350.

Since the opening of the shutter plate 351 is realized in accordance with the advance of the coin receiving portion 403 of the box 400, the coins C contained in the chamber 350 drop down into the coin receiving portion 403 and are taken out of the machine when the coin receiving box 400 is manually drawn out of the space 9.

When all of the coins C received in the coin receiving chambers 350 are to be taken out simultaneously in a mixed state, the hereinbefore mentioned coin receiving box (not shown) having a width covering the entire width of the coin take-out space 9 is inserted into the space 9, and then the handle 359 is pulled down. The downward movement of the handle 359 causes the arm 361 to be rotated around the shaft 360, and the lever 357 is thereby rotated clockwise around the shaft 360. The connecting lever 355 pin-connected to the other end of the lever 357 is thus shifted rearwardly, and the shutter plates 351, each connected through the rod 353 to the connecting lever 355, are all retracted simultaneously. Thus the coins C stored in the coin receiving chambers are discharged at the same time into the coin receiving box having the width covering the entire width of the coin take-out space 9.

In the above description, although the simultaneous opening of the shutter plates 351 has been effected by manipulation of the handle 359, and the individual opening of the shutter plate 351 has been described to be attained through the backward shift of the coin take-out boxes 400, it may be also possible for the simultaneous opening of the shutter plates 351 to be accomplished by means of a foot pedal or the like, and for the individual opening to be realized by a push button or the like which is operable independently of the movement of the coin receiving boxes 400.

Furthermore, although an example wherein the coins are taken out utilizing a space 9 below the coin receiving device 8 has been described above, it may also be so constructed that the coins are not received directly in the coin receiving boxes 400, but are received at a position remote from the machine utilizing, for instance, chutes and the like.

Since the coin receiving chambers 350 are made transparent as described above, any mixing of other kind of coins during the coin sorting operation can be easily detected. Furthermore, since the taking-out of coins is made possible in a simultaneous manner or in an individual manner, either way to be followed is selected depending on the convenience of the subsequent processes through which the coins are to undergo.

In the case where the coins are sorted in the coin sorting device 5 and received in the coin receiving chambers 350 without any erroneous operation, and hence it is desired that the thus classified and counted coins are stored in the till-drawer section 10, a required number of till-drawers 450 are inserted in the till-drawer section 10. In this case, the coin take-out boxes 400 are inserted in the space 9 in a reversed manner such that the coin receiving portion 403 opens down-wardly as shown in FIG. 23(B), and the cutout portion of the end wall 405 comes first so that the end wall 405 does not interfere with the downwardly bent portion 351*a* of the shutter plate 351.

Thus, when the handle 359 is depressed downwardly, the shutter plates 351 are simultaneously opened as described above, whereby the coins sorted and received in the coin receiving chambers 350 are passed through the coin guiding portion 404 of the box 400 and received in the till drawers 450 placed in the till-drawer section 10.

In the above described example of this invention, each of the coin take-out boxes 400 is not necessarily limited to the above described construction, but it may be formed into two separate pieces, one for receiving and taking-out purpose, and other for merely guiding the coins passing therethrough toward the till drawers 450 as described above. Likewise, the shutter plate 351 is not necessarily limited to the above described construction.

According to the present invention, chambers for temporarily receiving coins are provided at the ends of the coin sorting passageways, and the bottoms of the chambers are closed by freely openable shutter plates, a space for taking-out coins being provided below the chambers. As a result, the coins may be taken out in the sorted state or in the mixed state utilizing the coin taking out space, whereby the mixing of different kinds of coins or faulty coins can be detected quickly, and the efficiency of coin sorting operation can be substantially improved.

Amount Indicating Section

An amount indicating section essentially comprises an amount indicating device 11 wherein coin integrating counters of well known construction are arranged to indicate the amounts of coins having different monetary units. For instance, coin integrating counters 501*a* through 501*e* are arranged in this order from the top toward the bottom as viewed in FIGS. 1 and 27 so that the counter 501*a* indicates the total amount of coins of the highest monetary unit, the counter 501*b* indicates the total amount of coins of the second highest monetary unit, and so forth, until the counter 501*e* indicates the amount of coins of the lowest monetary unit.

However, in order to simplify the description of the amount indicating device 11, it is herein assumed that the counters 501*a* through 501*e* indicate the amounts of 100 yen coins, 50 yen coins, 10 yen coins, 5 yen coins, and one yen coins, respectively. Furthermore, the counters 501*a* through 501*e* are assumed to be of a substantially equal construction having the same number of digits. However, as due consequences of operations the counters 501*a*, 501*c*, and 501*e* are selected to be decimal counters, while the counters 501*b* and 501*d* for counting 50 yen coins and five yen coins are selected to be binary counters.

All of the above described counters 501*a* through 501*e* are provided internally of indicator panel 502, which constitutes one part of the front panel of the coin-handling machine body, and the amounts of the coins indicated on the digit wheels of the counters are observed through displaying windows 503*a* through 503*e* provided in the indicator panel 502 in alignment with the corresponding counters 501*a* through 501*e*.

Furthermore, the above described counters 501*b* and 501*c* for 50 yen coins and 10 yen coins, each of which always has 0 at the lowest digit position, are arranged in such a manner that the entire digits thereof are offset by one position toward the left, as viewed in FIG. 27, relative to the digits of the counters 501*d* and 501*e* for 5 yen coins and one yen coins, respectively, and the 0 at the lowest position for the counters 501*b* and 501*c* is permanently written or marked on the indicator panel 502.

Likewise, the counter 501*a* for 100 yen coins, the indication of which constantly has 00 at the lowest two positions thereof, is arranged in a manner such that all digits thereof are offset by one position toward the left, as viewed in FIG. 27, relative to the digits of the counters 501*b* and 501*c*, and the last two zeros are permanently marked on the indicator panel 502.

As best illustrated in FIGS. 25 and 26, clearing (or zero resetting) push buttons 504*a* through 504*e* are provided to project from the indicator panel 502 on the left-hand side of the counters 501*a* through 501*e*, respectively, and a planar member 505, the leftward edge of which is coupled to the indicator panel 502 through a hinge pin 506 and the rightward edge of which is slanted so that the planar member does not interfere with the observation of the counters 501*a* through 501*e*, is provided to cover the clearing push buttons 504*a* through 504*e*. On the rear side of the planar member 505, depressing pieces 507 made of a soft material are provided at positions abutting against the clearing push buttons 504*a* through 504*e*, so that when an operative portion 508 formed on the righthand side of the planar member 505 is pushed toward the indicator panel 502, all of the clearing push buttons 504*a* through 504*e* are depressed simultaneously by the depressing pieces 507, and the counters 501*a* through 501*e* are thereby reset to zero indication. On the front surface of the planar member 505, kinds of coins are clearly marked at positions aligned with the displaying windows 503 of the counters.

The amount indicating device 11 operates as follows.

The coins dumped into the coin collecting hopper 2 are passed through the coin delivery passageway 3 and classified with respect to their denominations in the coin classification devices 5. The coins thus classified are then passed through the coin classification passageways 6 to the coin counting device 7 so that the number of coins is counted therein. The number of coins thus counted for every kind of coins is added in each of the above-mentioned integrating counters wherein the cumulative total amount of a specific kind of coins is displayed by the successive rotations of digit wheels.

For instance, in the integrating counters 501*d* and 501*e* for the 5 yen coins and one yen coins, the display is effected only through the digit wheels, whereas in the integrating counters 501*b* and 501*c* for the 50 yen coins and 10 yen coins, the displays are effected by the combination of those indicated by the digit wheels and the permanently marked 0 on the indicator panel 502. Likewise, in the counter 501*a* for the 100 yen coins, the display is effected by the combination of those indicated by the digit wheels in the counter and the figures 00 marked on the indicator panel 502.

In the case where a cycle of counting operations is completed, and a next cycle of operations is about to start, the operative portion 508 of the planar member 505 is depressed, and all of the integrating counters 501*a* through 501*e* are simultaneously cleared to zero indication. When the depression of the operative portion 508 is removed, all of the clearing push buttons 504*a* through 504*e* are returned to their original state by spring means provided therein, and the next cycle of the counting operations for every kind of coin is started automatically.

In the present invention, although the plurality of clearing push buttons can be operated simultaneously as described above, it is of course possible, when it is desired, for the plurality of clearing push buttons to be depressed individually.

Furthermore, since the integrated amounts of the respective kinds of coins are indicated by the aid of permanently marked figures such as 0 or 00 as described hereinbefore, the displayable amounts of those coins are substantially increased although the integrating counters are provided with the same number of digit wheels for these kinds of coins. Here again, the arrangement of the individual integrating counters, which has been described to be vertical arrangement from the top to the bottom of the amount indicating section, may be so changed that the counters are provided, for instance, from right to left or vice versa, without reducing the advantageous effects and without departing from the scope of this invention.

Drive Control Section

The hereinbefore mentioned coin delivery device 4 has a pulley 556 550, as shown in FIG. 28, in an upper part on the rear side of the inclined plate 57, on the front side of which the classification passageways are provided. The pulley 550 rotates the revolving disc 106 also constituting are part of the coin delivery device 4. The pulley 550 may be driven from an electric motor in a manner such as that indicated in FIG. 29 or in FIGS. 30 and 31.

In an arrangement shown in FIG. 29, an idle roller 551 is normally urged against a driving roller 552 and the above mentioned pulley 550 under the action of a spring 554, and the idle roller 551 is retracted from the driving roller 552 and the pulley 550 upon energization of a solenoid 555. The driving roll 552 is coupled through a belt with a roll 557 for driving the hereinbefore described counting device 7, and the roll 557 is in turn coupled through a belt with a pulley provided on the rotating shaft of an electric motor M.

In another arrangement shown in FIGS. 30 and 31, a controlling member is provided in a driving system for the counting device 7 and the coin delivering device 4, the member comprising, for instance, a clutch 558 rotatably supporting a friction roller 559. The clutch 558 is shifted by a solenoid 560 against a spring force so that the friction roller 559 is thereby shifted to disengage a clutch plate 561 connected to the coin delivery device 4 from another clutch plate 562 connected to the driving side.

Furthermore, the counting device 7 is driven by the pulley 557, as shown in FIGS. 28 and 29, which pulley is thereafter coupled to a bevel gear 563 for rotating counting rollers 564. The counting rollers 564 are located in the proximity of the classification passageways 6, and coins in each of the passageways 6 are thereby counted one by one and sent toward the coin receiving device 8.

The operation of the drive control section will now be described with reference to FIG. 32.

The coins thrown into the coin collector or hopper 2 in mixed state are moved by gravity toward the coin delivery device 4. When a start button S is depressed in this state, a start relay 600 is operated, thereby closing contacts 600-1A for self-holding the relay 600, and opening the contacts 600-1B for rendering inoperative a delay relay 601 and a solenoid SOL. When the solenoid SOL is not energized, the friction roll 559 or the idle roll 551 is urged by a spring force to place the driving system in the coupled state.

The energization of the start relay 600 further closes contacts 600-2 which energizes another relay 602. The relay 602 is self-held by the contacts 602-1 which are closed simultaneously with the energization of the relay 602. Upon energization of the relay 602, the contacts 602-2 and 602-3 are closed, thus starting the motor M. The operation of the motor M causes the coin scooping parts 107 to be rotated in the coin supplying hopper 2 and to scoop coins one by one so that the coins are sent through the coin delivering passageways 3. The coins thus sent into the passageways 3 are classifeid with respect to their denominations by the coin sorting devices 5 in the coin sorting passageways 6 utilizing the differences in the diameters and the like, and the coins thus classified are thereafter sent through the respective passages to the counting devices 7.

The coin counting devices 7 comprise the rollers 564 located at the proximity of the coin sorting passageways 6, and rotated through the bevel gear 563 by the motor M, whereby the coins thus sorted are counted one by one, and sent into the coin receiving device 8.

When the coins are thus received in the coin receiving device 8, the stop button ST is automatically depressed by the coins. The depression of the stop button ST causes the start relay 600 to be de-energized, and the contacts 600-1B are returned to the closed state. Thus, the delay relay 601 and the solenoid SOL are energized for retracting the clutch 558, and the operation of the coin delivering device 4 is terminated. In this state, the coin counting device 7 still continues its coin counting operation, and continuously delivers the thus counted coins into the coin receiving device 8 until the operational period of the delay relay 601 terminates.

Thus, when the operation period of the delay relay 601 is selected to be an appropriate value, the classified coins can be completely delivered into the coin receiving device 8, after the termination of the operation of the coin delivering device 4, without any of the coins being left in the coin sorting passageways 6.

After the elapse of the predetermined period, the delay relay 601 is de-energized, whereby the contacts 602-3 are opened and the self-holding relay 602 is brought back to its original state. The return to the original state of the relay 602 opens the contacts 602-1, thereby stopping the operation of the motor M.

After the motor M is brought to a complete stop, coins thus classified and received in the receiving devices 8 may be taken out as described hereinbefore, or delivered into the till-drawer section.

According to the above described features of the drive controlling arrangement, since the operation of the counting device is stopped after a predetermined time from an instant when the operation of the coin delivering device has terminated, any possibility of clogging or jamming in the coin sorting passages or in the coin counting devices can be substantially eliminated, and smooth and efficient operation of the coin handling machine can be thereby obtained.

I claim:

1. In a coin classifying and counting machine including a mixed coin hopper means for collecting and reserving mixed coins of a plurality of denominations, coin delivery means including a revolving disc for conveying coins from said hopper means, a delivery passageway for aligning and delivering in orderly sequence the coins thus conveyed, sorting means positioned at intermediate parts of said delivery passageway for sorting the coins therein by denomination, sorting passageways for conveying by denomination the coins thus sorted, coin counting devices installed in respective sorting passageways to count coins of respective denominations, and a coin receiver section for accommodating in groups by denomination the coins thus counted, the improvement which comprises said coin receiver section being comprised of coin receiving chamber means for storing coins therein in accordance with coin denomination and disposed respectively under said sorting passageways, and a coin collecting means positioned beneath said coin receiving chamber means for receiving coins stored in said chamber means, said coin collecting means and said chamber means defining a space therebetween, said space comprising means to selectively receive therein further means to selectively allow passage of coins to said coin collecting means from said chamber means or block such passage and remove coins from said chamber means without reaching said coin collecting means.

2. The improved machine of claim 1 wherein said revolving disc has a coin scooping part adapted to scoop up the coins within the hopper means, thereby to convey out the same, and said delivery passageway being extended in a manner to be superposed over the upper back side of said revolving disc to cause the passageway and said coin scooping part to be aligned, and a coin holding plate constituting one wall member of the delivery passageway and slidably supporting one face of each coin in the passageway, said coin holding plate being adapted to be openable in a manner to separate from said revolving disc, thereby to afford access to the passageway and related parts for removal of coins and for maintenance work.

3. An improved coin classifying and counting machine as claimed in claim 1, wherein said sorting passageways are in the form of alignment passageways comprising means for aligning respective coins in orderly sequence and causing the thus aligned coins to undergo sliding descent.

* * * * *